US010024497B2

(12) United States Patent
Heikka et al.

(10) Patent No.: US 10,024,497 B2
(45) Date of Patent: Jul. 17, 2018

(54) PNEUMATIC EMERGENCY SHUTDOWN SYSTEM

(71) Applicant: Skangas AS, Tananger (NO)

(72) Inventors: Matti Heikka, Hämeenlinna (FI); Bo Winberg, Göteborg (SE)

(73) Assignee: SKANGAS AS, Tananger (NO)

( * ) Notice: Subject to any disclaimer, the term of this patent is extended or adjusted under 35 U.S.C. 154(b) by 0 days.

(21) Appl. No.: 15/449,175

(22) Filed: Mar. 3, 2017

(65) Prior Publication Data

US 2017/0254478 A1 Sep. 7, 2017

(30) Foreign Application Priority Data

Mar. 3, 2016 (FI) ..... 20165171

(51) Int. Cl.

| | |
|---|---|
| ***F17C 5/02*** | (2006.01) |
| ***F17C 7/02*** | (2006.01) |
| ***F17C 13/02*** | (2006.01) |
| ***F17C 13/04*** | (2006.01) |

(52) U.S. Cl.

CPC ..... *F17C 5/02* (2013.01); *F17C 7/02* (2013.01); *F17C 13/025* (2013.01); *F17C 13/04* (2013.01); *F17C 2221/033* (2013.01); *F17C 2250/03* (2013.01); *F17C 2250/07* (2013.01)

(58) Field of Classification Search

CPC .. F17C 5/02; F17C 7/02; F17C 13/025; F17C 13/04; F17C 2221/033; F17C 2250/03; F17C 2250/07

See application file for complete search history.

(56) References Cited

U.S. PATENT DOCUMENTS

| | | | | |
|---|---|---|---|---|
| 4,266,580 | A | 5/1981 | Dixon | |
| 4,805,672 | A | 2/1989 | Berrettini et al. | |
| 6,012,482 | A | 1/2000 | Nelson et al. | |
| 6,216,719 | B1 * | 4/2001 | Meyer | B67D 7/3209 137/487.5 |
| 6,260,568 | B1 | 7/2001 | Hsu et al. | |
| 6,622,758 | B2 | 9/2003 | Drube et al. | |
| 6,786,245 | B1 * | 9/2004 | Eichelberger | B60S 5/02 141/18 |

(Continued)

FOREIGN PATENT DOCUMENTS

| | | |
|---|---|---|
| EP | 1 452 794 A2 | 9/2004 |
| EP | 2 062 850 A2 | 5/2009 |

(Continued)

OTHER PUBLICATIONS

European Search Report dated Aug. 18, 2017 for Application No. EP 17158846.0.

*Primary Examiner* — Eric Keasel
(74) *Attorney, Agent, or Firm* — Ladas & Parry LLP

(57) ABSTRACT

The invention relates to a pneumatic emergency shutdown system for a liquefied gas supply arrangement in which liquefied gas is supplied between a first tank and a second tank. The pneumatic emergency shutdown system comprises a pneumatic emergency shutdown circuit comprising pressure medium and provided in connection with the first tank and a pneumatic emergency shutdown link provided to the pneumatic emergency shutdown circuit, said a pneumatic emergency shutdown link connecting the pneumatic emergency shutdown circuit to a pneumatic controlling system of the second tank.

17 Claims, 2 Drawing Sheets

(56) References Cited

U.S. PATENT DOCUMENTS

| | | | | |
|---|---|---|---|---|
| 6,904,944 | B2 * | 6/2005 | Satou | F17C 5/00 141/100 |
| 7,032,606 | B1 * | 4/2006 | Lucas, Jr. | G05D 16/2046 137/12 |
| 7,406,979 | B2 * | 8/2008 | Wodjenski | F17C 13/04 137/15.04 |
| 7,591,290 | B2 * | 9/2009 | Bourgeois | F17C 5/007 141/231 |
| 7,870,878 | B2 * | 1/2011 | Zhevago | F17C 1/14 141/18 |
| 8,453,688 | B2 * | 6/2013 | Allidieres | F17C 5/007 137/487 |
| 2002/0104581 | A1 | 8/2002 | Drube et al. | |
| 2009/0071171 | A1 | 3/2009 | Zia et al. | |

FOREIGN PATENT DOCUMENTS

| | | |
|---|---|---|
| EP | 2 062 850 A3 | 10/2009 |
| EP | 1 452 794 A3 | 4/2011 |

* cited by examiner

PNEUMATIC EMERGENCY SHUTDOWN SYSTEM

FIELD OF THE INVENTION

The present invention relates to a pneumatic emergency shutdown system for a liquefied gas supply arrangement, and more particularly to a pneumatic emergency shutdown system as defined in the independent claim 1.

BACKGROUND OF THE INVENTION

The invention relates to a pneumatic emergency shutdown system and particularly to a pneumatic emergency shutdown system for a liquefied gas supply arrangement in which liquefied gas is supplied between a first tank and a second tank such as a delivering truck and a receiving vessel and/or a receiving terminal or liquefied gas storage tank. The system is a pneumatic safety arrangement for preventing human errors occurring in the loading and unloading liquefied gas in particularly liquefied natural gas ("LNG"). The system is automated.

An emergency shutdown system is typically known as an emergency shutdown valve and an associated valve actuator, i.e. a valve that stops flow in an emergency. An emergency shutdown system is a requirement for the carriage of liquefied gases.

Growth of the truck deliveries of liquefied gas, for example LNG, has brought up many safety issues and there is a need for an automated ESD-link between the truck and the receiving vessel. Previously there has been no other link between the truck and the receiving vessel other than a human link. In case of an emergency, when the emergency shutdown system is activated in the receiving vessel, there is no existing automated system that transfers the emergency shutdown system signal to the delivering truck and launches the truck's own emergency shutdown system. The way to inform the driver about the activated emergency shutdown system in the receiving vessel insist the action from the user which leads to a possibility of the human error being present.

Publication U.S. Pat. No. 6,622,758 discloses a pressure sensing line that detects the cryogenic liquid pressure at the off-loading port of a dispensing station. The off-loading port connects the tank of a delivery vehicle. Each of the dispensing station valves is connectable to the off-loading port. Each valve is kept closed, if the cryogenic liquid pressure is below a preset level. The invention disclosed in the publication prevents cryogenic liquid spill in case of drive offs, controller error or failure in dispensing station valves. So the publication discloses a system for dispensing LNG from a delivery truck to a storage tank at a dispensing station. A device is disclosed which has an emergency shutdown valve which can be activated with a pneumatic signal from the far end of the supplying pipe closing the valve at the delivery truck. In the publication the pneumatic signal controlling the valve is activated simply by detecting a drop in pressure in the supplying pipe which is not a signal of an ESD system of the receiving party. Also the receiving party is a storage tank which does not have an ESD system.

The present invention eliminates the human error possibility from the delivery chain between the delivering and receiving vessels. It also minors the danger zones needed for unloading/loading the liquefied gas, for example LNG, because the automated system diminishes the amount of released/leaked liquefied gas in case of total emergency.

BRIEF DESCRIPTION OF THE INVENTION

An object of the present invention is to provide a pneumatic emergency shutdown system so as to solve the above problems. The objects of the invention are achieved by the pneumatic emergency shutdown system which is characterized by what is stated in the independent claim. The preferred embodiments of the invention are disclosed in the dependent claims.

The invention is based on the idea of providing a pneumatically operated emergency shutdown system for preventing a human error when liquefied gas is supplied between two tanks. According to the invention liquefied gas, such as LNG, is transferred between a first tank and a second tank. The transfer can for example be arranged between a delivery truck comprising a tank and a receiving ship or a vessel comprising a second tank or a supply terminal and a delivery truck.

According to the invention a pneumatic emergency shutdown system is provided for a liquefied gas supply arrangement in which liquefied gas is supplied between a first tank and a second tank. The first tank and the second tank are distant from each other which means that they are in separate locations, for example the first tank is arranged in a ship and the second tank is arranged in a truck. The pneumatic emergency shutdown system comprises a pneumatic emergency shutdown circuit comprising pressure medium and provided in connection with the first tank. This means that the pneumatic emergency shutdown circuit is arranged to have a connection with the first tank such that the pneumatic emergency shutdown circuit provides information for a process control system that controls the processes relating to the first tank, for example unloading from the first tank and/or loading to the first tank, i.e. the process control system is a system relating to the first tank and advantageously a distributed control system working together with a safety instrumented system that controls together with the distributed control system critical interlocking of the processes relating to the first tank. The pneumatic emergency shutdown system further comprises a pneumatic emergency shutdown link provided to the pneumatic emergency shutdown circuit. The pneumatic emergency shutdown link connects the pneumatic emergency shutdown circuit to a pneumatic controlling system of the second tank. This means that the second tank comprises own pneumatic controlling system that is connected through the pneumatic emergency shutdown link to the pneumatic emergency shutdown circuit of the first tank.

The pneumatic emergency shutdown system further comprises a parking coupling provided to the pneumatic emergency shutdown circuit for receiving the pneumatic emergency shutdown link to a park position when the pneumatic emergency shutdown circuit is disconnected from the pneumatic controlling system of the second tank and a supply coupling provided in connection with the second tank for receiving the pneumatic emergency shutdown link to a supply position when the pneumatic emergency shutdown circuit is connected to the pneumatic controlling system of the second tank. The pneumatic emergency shutdown link connects the pneumatic emergency shutdown circuit in operation with the pneumatic controlling system of the second tank for feeding from the pneumatic controlling system of the second tank pressure to the pneumatic emergency shutdown circuit. When the tanks are not connected together, i.e. the pneumatic emergency shutdown circuit is not in connection with the pneumatic controlling system of the second tank the pneumatic emergency shutdown link is arranged in the parking position, i.e. in connection with the parking coupling such that the pneumatic emergency shutdown circuit comprises a first pressure when the pneumatic emergency shutdown circuit is a closed circuit. The first pressure is a normal pressure in the pneumatic emergency shutdown circuit when it is a closed circuit and the first pressure is for example around 2 bars. The first pressure is maintained through a pressure regulator.

The pneumatic emergency shutdown system further comprises a first valve provided to the pneumatic emergency shutdown circuit. The first valve is operable between an open position and a closed position in response for pressure change in the pneumatic emergency shutdown circuit for opening and closing the pneumatic emergency shutdown circuit. A pressure sensor is provided between the pneumatic emergency shutdown link and the first valve, the pressure sensor is operatively connected to the first valve for opening and closing the first valve in response to a pressure change in the pneumatic emergency shutdown circuit. A pressure regulator is provided between the first valve and the parking coupling for regulating the pressure in the pneumatic emergency shutdown circuit when the pneumatic emergency shutdown link is connected to the parking coupling, i.e. when the pneumatic emergency shutdown circuit is closed. The pneumatic emergency shutdown system further comprises a second valve provided between the first valve and the parking coupling for controlling the operating state of the pneumatic emergency shutdown system.

An advantage of the pneumatic emergency shutdown system of the invention is that it improves security of the person operating the loading or unloading process of the liquefied gas because the pneumatic emergency shutdown circuit is activated by connecting the pneumatic emergency shutdown link to the supply coupling such that a connection between the pneumatic emergency shutdown circuit and the pneumatic controlling system of the second tank is formed and only then the loading or unloading can be operated and if problems occur and there is a bleed in the system the circuit will be deactivated and the supply ends.

BRIEF DESCRIPTION OF THE DRAWINGS

In the following the invention will he described in greater detail by means of preferred embodiments with reference to the attached drawings, in which.

DETAILED DESCRIPTION OF THE INVENTION

Figure 1:
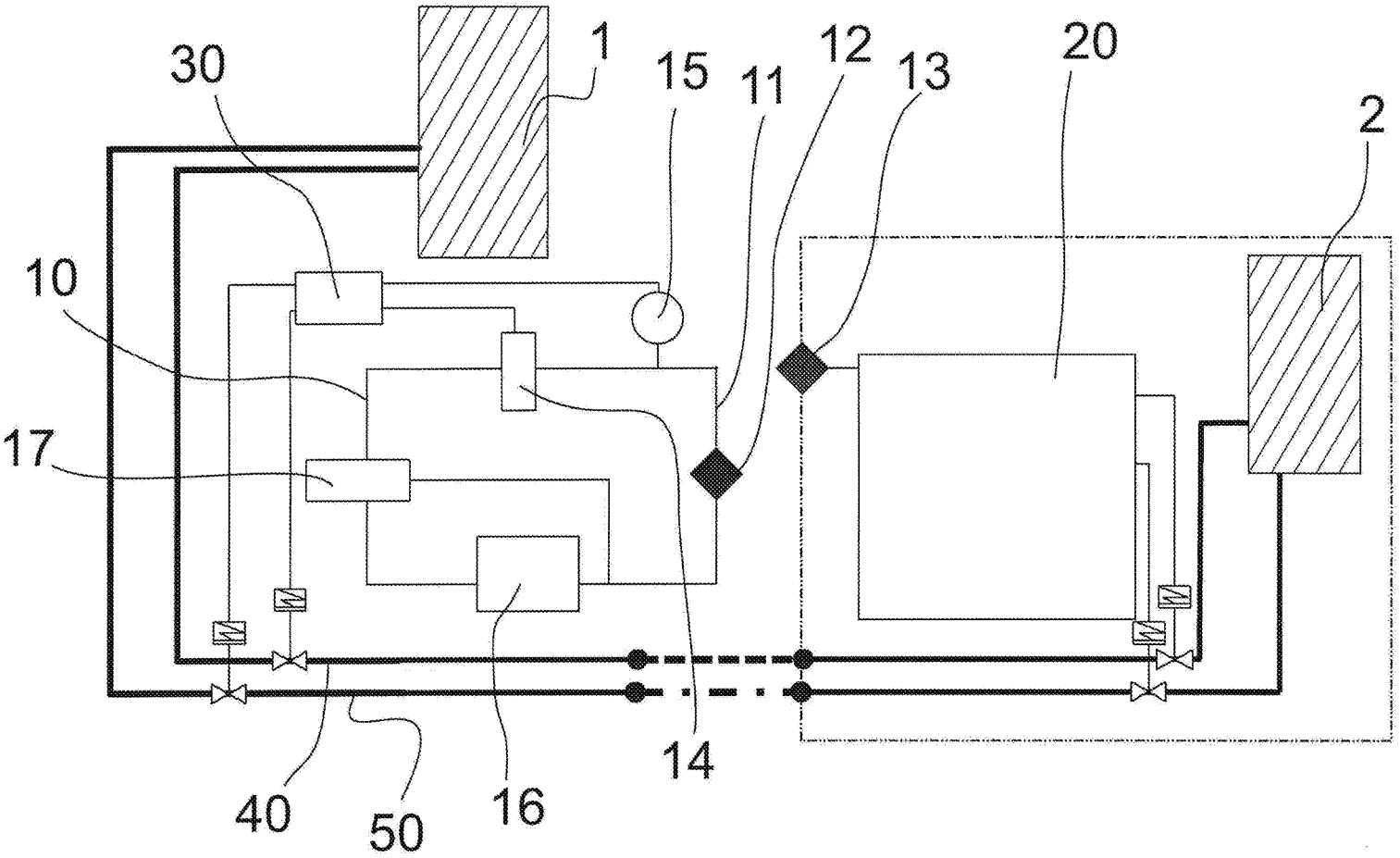
FIG. 1 shows the pneumatic emergency shutdown system according to the invention in a first operation position.

FIG. 1 shows the pneumatic emergency shutdown system for a liquefied gas supply arrangement according to the invention in which liquefied gas is supplied between a first tank 1 and a second tank 2. The dashed line around the second tank 2 and the pneumatic controlling system 20 shows the range of the second tank 2 which means that for example in case of a trailer the dashed line illustrates the trailer comprising the second tank 2 and the pneumatic controlling system 20.

Figure 2:
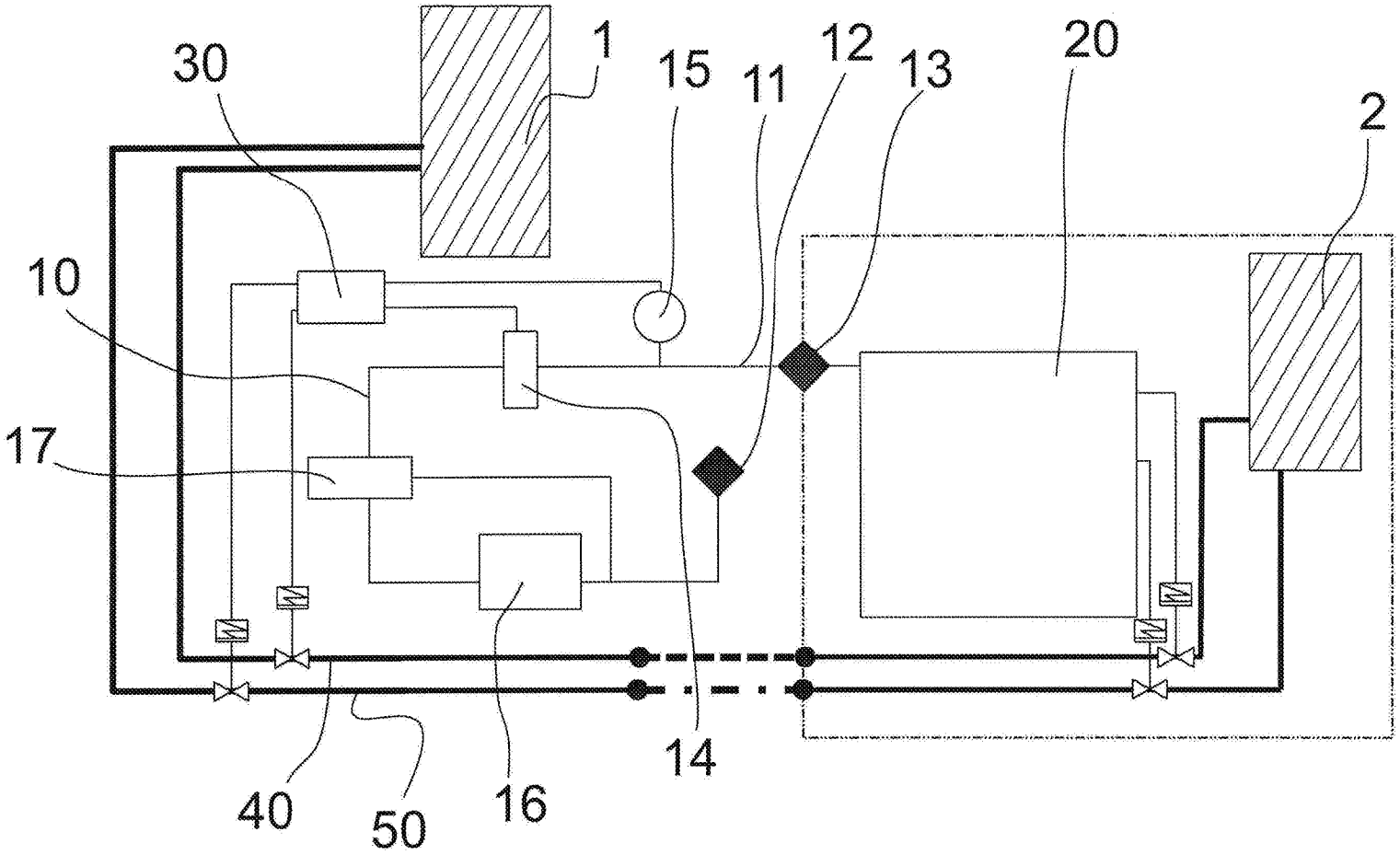
FIG. 2 shows the pneumatic emergency shutdown system according to the invention in a second operation position.

The pneumatic emergency shutdown system according to the invention comprises a pneumatic emergency shutdown circuit 10 comprising pressure medium and provided in connection with the first tank 1. A pneumatic emergency shutdown link 11 is provided to the pneumatic emergency shutdown circuit 10 and shown in FIG. 1 with a dotted line. The pneumatic emergency shutdown link 11 is arranged to connect the pneumatic emergency shutdown circuit 10 to a pneumatic controlling system of the second tank 2, but in FIG. 1 the connection is deactivated, i.e. there is no connection. In FIG. 2 the pneumatic emergency shutdown circuit 10 and the pneumatic controlling system 20 of the second tank 2 are connected.

A parking coupling 12 is provided to the pneumatic emergency shutdown circuit 10 for receiving the pneumatic emergency shutdown link 11 to a park position when the pneumatic emergency shutdown circuit 10 is disconnected from the pneumatic controlling system of the second tank 2. FIG. 1 shows a supply coupling 13 provided in connection with the second tank 2 for receiving the pneumatic emergency shutdown link 11 to a supply position when the pneumatic emergency shutdown circuit 10 is connected to the pneumatic controlling system of the second tank 2.

A first valve 14 is provided to the pneumatic emergency shutdown circuit 10. The first valve 14 is operable between an open position and a closed position for opening and closing the pneumatic emergency shutdown circuit 10. A pressure sensor 15 is provided between the pneumatic emergency shutdown link 11 and the first valve 14, the pressure sensor 15 is operatively connected to the first valve 14 for opening and closing the first valve 14 in response to a pressure change in the pneumatic emergency shutdown circuit 10.

A pressure regulator 16 is provided between the first valve 14 and the parking coupling 12 for regulating the pressure in the pneumatic emergency shutdown circuit 10 when the pneumatic emergency shutdown link 11 is connected to the parking coupling 12 and a second valve 17 provided between the first valve 14 and the parking coupling 12 for controlling the operating state of the pneumatic emergency shutdown system. The pressure regulator 16 is arranged to regulate the pressure of the pneumatic emergency shutdown circuit 10. In other words the pressure regulator 16 is arranged to provide the first pressure to the pneumatic emergency shutdown circuit 10.

FIG. 1 further shows that the pneumatic emergency shutdown circuit 10 comprises a connection to a process control system 30 through the pressure sensor 15 and the first valve 14 such that the pressure sensor 15 is arranged to transmit data of the pressure in the pneumatic emergency circuit 10 to the process control system 30 and said process control system 30 is arranged to provide command for the first valve 14 for opening or closing the pneumatic emergency shutdown circuit 10 in response to a pressure change in the pneumatic emergency shutdown circuit 10.

In FIG. 1 the pneumatic emergency shutdown circuit 10 is a closed circuit because the pneumatic emergency shutdown link 11 is in the parking position, i.e. the pneumatic emergency shutdown link 11 is connected with the parking coupling 12 and a first pressure is provided in the pneumatic emergency shutdown circuit 10. The pneumatic emergency shutdown link 11 is arranged to operate for activating and deactivating the pneumatic emergency shutdown circuit 10, i.e. when the pneumatic emergency shutdown link 11 is connected to the parking coupling 12 as in FIG. 1 the pneumatic emergency shutdown circuit 10 is deactivated and as shown FIG. 2 when the pneumatic emergency shutdown link 11 is connected to the supply coupling 13 the pneumatic emergency shutdown circuit is activated. When the pneumatic emergency shutdown circuit 10 is deactivated it comprises a first pressure which is maintained through the pressure regulator 16. The pneumatic emergency shutdown circuit 10 is activated by connecting the pneumatic emergency shutdown link 11 to the supply coupling 13 such that a connection between the pneumatic emergency shutdown circuit 10 and the pneumatic controlling system 20 of the second tank 2 is formed as shown in FIG. 2.

FIG. 2 shows the same pneumatic emergency shutdown system as in FIG. 1 but now the pneumatic emergency shutdown circuit 10 of the first tank 1 is connected to the pneumatic controlling system 20 of the second tank 2 and said pneumatic emergency shutdown circuit 10 comprises a second pressure because the pneumatic emergency shutdown circuit 10 is an open circuit and connected to the pneumatic controlling system 20 having a different pressure than the first pressure. In other words the pneumatic emergency shutdown circuit 10 is an open circuit when the pneumatic emergency shutdown link 11 is in the supply position such that the pneumatic emergency shutdown link 11 is connected with the supply coupling 13 and a second pressure is provided in the pneumatic emergency shutdown circuit 10.

During operation of the pneumatic emergency shutdown circuit 10 the second pressure is greater than the first pressure and the first valve 14 is arranged to open in response to the pressure sensor 15 sensing pressure rising above or equalling with the first pressure and to close in response to the pressure sensor 15 sensing pressure decreasing below the first pressure. The first pressure is the pressure in which the pneumatic emergency shutdown circuit is in operation and the first valve 14 is open and is arranged to connect the second valve 17 and the emergency shutdown link 11. In other words the first pressure is a parking pressure because the emergency shutdown link 11 is in the parking position and the pneumatic emergency shutdown circuit is an open circuit. When the first valve is open the pressure stays in the circuit. When the circuit is released that is when the pressure drops below the first pressure, i.e. the parking pressure, the first valve 14 changes position, i.e. closes, and connection to atmospheric air opens and connection to the second valve 17 closes. In that case the emergency shutdown link 11 is depressurised to the atmosphere and the pressure drops in the pressure sensor 15 and in the pneumatic controlling system 20.

As shown in FIGS. 1 and 2 the pressure regulator 16 is provided between the second valve 17 and the parking coupling 12. However the pneumatic emergency shutdown circuit 10 may comprise a branch line provided between the second valve 17 and the parking coupling 12 for overriding the pressure regulator 16.

In a preferred embodiment of the invention the pneumatic emergency shutdown system is arranged in connection with a ship such that the first tank 1 is the tank of the ship.

In another embodiment of the invention the pneumatic emergency shutdown system is arranged in connection with a loading/receiving terminal such that the first tank 1 is the tank of the loading/receiving terminal or the pneumatic emergency shutdown system is arranged in connection with a customer container. The loading/receiving terminal is for supplying and/or receiving the liquefied gas.

In a preferred embodiment of the invention the second tank 2 is in a truck or in a trailer or in a separate container.

In another embodiment of the invention there may be multiple pneumatic controlling systems of the second tanks such that for example when the second tank 2 is in a truck there may be multiple trucks each comprising a tank and a pneumatic controlling system 20 and the pneumatic controlling systems of each truck are connected together and one of the pneumatic systems of the second tank 2 is connected as a branch line to the pneumatic emergency shutdown circuit 10. In that case all the trucks can be loading the liquefied gas to the first tank 1 but still all the pneumatic controlling systems and the pneumatic emergency shutdown circuit are in connection with each other. If needed only the multiple second tanks 2 comprising the pneumatic controlling systems may be connected together if needed.

Next one example is provided of how a truck driver who is loading or unloading a truck comprising the second tank 2 operates within the pneumatic emergency shutdown system. The pneumatic emergency shutdown link 11 is connected to the parking coupling 12 and the pneumatic emergency shutdown circuit 10 comprises a first pressure which is preferably set for 2-3 bars. When the driver arrives to the loading/unloading place comprising the first tank 1 he armes the trailer's pneumatic controlling system 20 and then disconnects the pneumatic emergency shutdown link 11 from the parking coupling 12 of the pneumatic emergency shutdown circuit 10 and connects it to the supply coupling 13 which connects the pneumatic emergency shutdown circuit 10 in connection with the first tank 1 and the pneumatic controlling system 20 of the second tank 2. The driver must connect the pneumatic emergency shutdown link 11 to the supply coupling 13 after disconnecting it from the parking coupling 12 otherwise the pressure will slowly decrease in the pneumatic emergency shutdown circuit 10 and make an alarm so that the pressure sensor 15 senses the pressure change and activates preset-levels programmed to a process control system 30. After the driver has connected the pneumatic emergency shutdown link 11, the pneumatic controlling system 20 of the second tank 2 within the truck will pressurize the pneumatic emergency shutdown circuit 10 according the set level of the trailers own pressure set level. This is for example above 4 bars. The increased pressure is measured by the pressure sensor 15 in the pneumatic emergency shutdown circuit 10 and the data is transferred to the process control system 30 which understands that the trailer is connected to the pneumatic emergency shutdown circuit via the pneumatic emergency shutdown link 11 and the process control system 30 gives permission to start the loading/unloading process.

FIGS. 1 and 2 show that the liquefied gas is supplied through a liquefied gas line 40 between the first tank 1 and the second tank 2 and a vapor line 50 is provided for vapor returns between said first tank 1 and said second tank 2.

The process control system 30 is connected to the liquefied gas line 40 and to the vapor line 50 through valves which operate according to the commands given from the process control system 30 for opening and closing said valves.

It will be obvious to a person skilled in the art that, as the technology advances, the inventive concept can be implemented in various ways. The invention and its embodiments are not limited to the examples described above but may vary within the scope of the claims.

The invention claimed is:

1. A pneumatic emergency shutdown system for a liquefied gas supply arrangement in which liquefied gas is supplied between a first tank and a second tank, the pneumatic emergency shutdown system comprising a pneumatic emergency shutdown circuit comprising pressure medium and provided in connection with the first tank, a pneumatic emergency shutdown link provided to the pneumatic emergency shutdown circuit, said a pneumatic emergency shutdown link connecting the pneumatic emergency shutdown circuit to a pneumatic controlling system of the second tank;

a parking coupling provided to the pneumatic emergency shutdown circuit for receiving the pneumatic emergency shutdown link to a park position when the pneumatic emergency shutdown circuit is disconnected from the pneumatic controlling system of the second tank;

a supply coupling provided in connection with the second tank for receiving the pneumatic emergency shutdown link to a supply position when the pneumatic emergency shutdown circuit is connected to the pneumatic controlling system of the second tank;

a first valve provided to the pneumatic emergency shutdown circuit, said first valve is operable between an open position and a closed position in response for pressure change in the pneumatic emergency shutdown circuit for opening and closing the pneumatic emergency shutdown circuit;

a pressure sensor provided between the pneumatic emergency shutdown link and the first valve, the pressure sensor is operatively connected to the first valve for opening and closing the first valve in response to a pressure change in the pneumatic emergency shutdown circuit;

a pressure regulator provided between the first valve and the parking coupling for regulating the pressure in the pneumatic emergency shutdown circuit when the pneumatic emergency shutdown link is connected to the parking coupling; and a second valve provided between the first valve and the parking coupling for controlling the operating state of the pneumatic emergency shutdown system.

2. A pneumatic emergency shutdown system according to claim 1, wherein the pneumatic emergency shutdown circuit comprises a connection to a process control system through the pressure sensor and the first valve such that the pressure sensor is arranged to transmit data of the pressure in the pneumatic emergency circuit to the process control system and said process control system is arranged to provide command for the first valve for opening or closing the pneumatic emergency shutdown circuit in response to a pressure change in the pneumatic emergency shutdown circuit.

3. A pneumatic emergency shutdown system according to claim 2, wherein the pneumatic emergency shutdown circuit comprises a first pressure when the pneumatic emergency shutdown circuit is a closed circuit.

4. A pneumatic emergency shutdown system according to claim 2, wherein the pneumatic emergency shutdown circuit is a closed circuit when the pneumatic emergency shutdown link is in the parking position such that the pneumatic emergency shutdown link is connected with the parking coupling and a first pressure is provided in the pneumatic emergency shutdown circuit.

5. A pneumatic emergency shutdown system according to claim 1, wherein the pneumatic emergency shutdown circuit comprises a first pressure when the pneumatic emergency shutdown circuit is a closed circuit.

6. A pneumatic emergency shutdown system according to claim 5, wherein the pressure regulator is arranged to provide the first pressure to the pneumatic emergency shutdown circuit.

7. A pneumatic emergency shutdown system according to claim 1, wherein the pneumatic emergency shutdown circuit is a closed circuit when the pneumatic emergency shutdown link is in the parking position such that the pneumatic emergency shutdown link is connected with the parking coupling and a first pressure is provided in the pneumatic emergency shutdown circuit.

8. A pneumatic emergency shutdown system according to claim 7, wherein the pneumatic emergency shutdown circuit comprises a second pressure when the pneumatic emergency shutdown circuit is an open circuit.

9. A pneumatic emergency shutdown system according to claim 8, wherein the pneumatic emergency shutdown circuit is an open circuit when the pneumatic emergency shutdown link is in the supply position such that the pneumatic emergency shutdown link is connected with the supply coupling and a second pressure is provided in the pneumatic emergency shutdown circuit.

10. A pneumatic emergency shutdown system according to claim 9, wherein during operation of the pneumatic emergency shutdown circuit the second pressure is greater than the first pressure and the first valve is arranged to open in response to the pressure sensor sensing pressure being equal or rising above the first pressure and to close in response to the pressure sensor sensing pressure decreasing below the first pressure.

11. A pneumatic emergency shutdown system according to claim 7, wherein the pressure regulator is arranged to provide the first pressure to the pneumatic emergency shutdown circuit.

12. A pneumatic emergency shutdown system according to claim 1, wherein the pressure regulator is provided between the second valve and the parking coupling.

13. A pneumatic emergency shutdown system according to claim 12, wherein pneumatic emergency shutdown circuit comprises a branch line provided between the second valve and the parking coupling for overriding the pressure regulator.

14. A pneumatic emergency shutdown system according to claim 1, wherein pneumatic emergency shutdown circuit comprises a branch line provided between the second valve and the parking coupling for overriding the pressure regulator.

15. A pneumatic emergency shutdown system according to claim 1, wherein the pneumatic emergency shutdown system is arranged in connection with a ship such that the first tank is the tank of the ship.

16. A pneumatic emergency shutdown system according to claim 1, wherein the pneumatic emergency shutdown system is arranged in connection with a loading/receiving terminal such that the first tank is the tank of the loading/receiving terminal.

17. A pneumatic emergency shutdown system according to claim 1, wherein the second tank is in a truck or in a trailer or in a container.

* * * * *